US008002199B2

(12) United States Patent
Habegger

(10) Patent No.: US 8,002,199 B2
(45) Date of Patent: Aug. 23, 2011

(54) HIGHLY SENSITIVE AIRFLOW DIRECTION SENSING

(76) Inventor: Millard A. Habegger, Boulder, CO (US)

( * ) Notice: Subject to any disclaimer, the term of this patent is extended or adjusted under 35 U.S.C. 154(b) by 462 days.

(21) Appl. No.: 12/316,269

(22) Filed: Dec. 12, 2008

(65) Prior Publication Data

US 2010/0147964 A1 Jun. 17, 2010

(51) Int. Cl.
*F24F 7/00* (2006.01)
*G01F 13/00* (2006.01)
*G01F 5/00* (2006.01)

(52) U.S. Cl. ..... 236/49.3; 73/170.12; 73/204.22

(58) Field of Classification Search ..... 236/49.3; 700/282, 299; 73/204.22, 204.11, 204.21, 73/170.12
See application file for complete search history.

(56) References Cited

U.S. PATENT DOCUMENTS 4,406,396 A 9/1983 Habegger
4,637,253 A 1/1987 Sekimura et al.
5,039,006 A 8/1991 Habegger
5,461,910 A * 10/1995 Hodson et al. ..... 73/170.12
6,328,647 B1 12/2001 Traudt
6,983,652 B2 1/2006 Blakley et al.

* cited by examiner

*Primary Examiner* — Chen-Wen Jiang
(74) *Attorney, Agent, or Firm* — Harold A. Burdick

(57) ABSTRACT

Sensors, apparatus and methods are disclosed for detecting airflow direction between two volumes. The preferred airflow sensor includes a tube for conducting an airflow stream between the volumes, a first temperature sensor sensing ambient temperature in the first volume and a second temperature sensor sensing temperature of the airflow stream in the tube. A heat source heats air in the tube adjacent the end thereof communicating with the second volume and a comparator receives and compares output signals from the temperature sensors, providing an output indicative thereof. Various means are provided responsive to the output advancing appropriate response thereto. The disclosed sensors, apparatus and methods are particularly well adapted for indicating positive and negative pressure differentials at flues associated with combustion appliances.

20 Claims, 5 Drawing Sheets

HIGHLY SENSITIVE AIRFLOW DIRECTION SENSING

FIELD OF THE INVENTION

This invention relates to airflow direction sensing, and, more particularly, relates to airflow direction sensing between different volumes of air.

BACKGROUND OF THE INVENTION

Air and water heating and conditioning appliances utilizing gas combustion are in extensive usage worldwide, and their safe installation and use in occupied facilities is of ongoing concern. This concern has led, for example, to an entire industry based on sensing the presence of carbon monoxide in the occupied portions of such facilities. Such sensors are responsive to dangerous conditions only after the conditions are present in a facility and a threat to occupants, are of debatable sensitivity and reliability, are not remediative, and are thus less than adequate solutions to the safety problem.

A goal of some in the industry has been to provide means making facility/home HVAC safety sensor based rather than containment based (through the use of air ducts and the like). Modern combustion appliance installation must assure proper flue chimney draft, particularly in view of the large pressure differentials which power fans used for air distribution can produce. Presently, this is accomplished using air duct systems to isolate the air distribution system from the combustion air supply and flue venting. One consequence of this isolation is that the distribution air flow is stifled, impacting system efficiency (high distribution air flow is of key importance to heating and cooling energy efficiency). To replace or eliminate certain duct systems (particularly supply/return air duct systems) thereby to enhance distribution air flow, a sensor would be required that is responsive to low flue/chimney draft type pressure differentials and capable of differentiating flue draft airflow direction. To date, such a sensor with sufficiently high sensitivity and reliability has not existed.

Various approaches to sensing available flue draft in a variety of implementations have heretofore been suggested and or utilized (see U.S. Pat. Nos. 4,406,396 and 5,039,006). While useful, such approaches have required draft sensing at each combustion appliance and have not been simple to implement, install and/or adapt in various applications.

Improvements directed to alleviation of the lack of adequate distribution air flow in homes and other facilities, and thus improvement of heating/cooling efficiency, would be desirable. To convey one BTU of heat with 1° F. temperature rise in sea level air requires the movement of 55 cubic feet of air. A typical central furnace burning one therm (100,000 BTU) per hour requires air with a 30° F. temperature rise in the amount of 3000 cubic feet per minute (cfm). It is important to keep the temperature rise somewhat reasonable or the losses in the ducts due to thermal conduction and small air leaks will be substantial. An air conditioner (AC) or heat pump creating cooling or heating of 30,000 BTU per hour requires air with a 10° F. temperature rise in the amount of 2750 cfm. With this equipment, the figure of merit (heat removed divided by the net work input) is inversely proportional to the temperature difference between the source and the sink (indoors and outdoors). It is therefore very important to keep that temperature difference small or the distribution air temperature above or below the ambient small. These large airflow requirements are seldom met (even in modern homes the typical total airflow is down from these numbers by a factor of 5 to 10).

Under current building codes, the needed airflow requires either very large ducts or very streamlined high velocity ducts, both of which are expensive to provide and install and consume valuable building space. One solution to both problems would be ductless return air systems. Use of such an open return would greatly facilitate the utilization of low grade heat and cooling sources and the redistribution of air throughout the facility/home. However, to accommodate usage of such ductless return systems the open return air path (particularly at the combustion appliance) must be made safe. One solution would be to provide pressure sensing between the indoor and outdoor wherein pressure differentials as little as 0.005 inches of water could be sensed in the vicinity of the flue. But, as noted heretofore, no such sensing solution has been forthcoming, and suitable pressure sensors (having adequate sensitivity) have not been available. While a number of systems have been suggested which might be adapted and/or implemented (see, for example, U.S. Pat. Nos. 4,637,253, 6,328,647 and 6,983,652), none resolve all the problems which need to be addressed and/or satisfy the particular requirements of the industry. Further improvement could, therefore, still be utilized.

SUMMARY OF THE INVENTION

This invention provides sensors/apparatus and methods well suited to a number of applications requiring a highly reliable and sensitive determination of airflow direction between two volumes, for example in a combustion flue to indicate positive and negative pressure differentials between the interior and exterior of a facility. The sensors/apparatus are adaptable for utilization of a single sensor system wide in a combustion appliance assemblage, are simple to implement, install and/or adapt in various applications, and are relatively inexpensive.

The sensors/apparatus and methods of this invention enhance combustion appliance safety, are responsive to dangerous conditions before they become a threat to occupants, and are remediative in nature. The sensor/apparatus provides means adaptable for response to low flue/chimney draft type pressure differentials and for differentiating flue draft airflow direction, thereby enhancing occupant safety by reliably indicating and responding to negative indoor pressure with respect to the outdoors in facilities/homes using modern combustion appliances. The sensor/apparatus and methods of this invention provide a heretofore unavailable simple, reliable, self-contained digital electrical signal indicative of proper and improper flue draft with a high degree of sensitivity (+/−0.001 inches of water column).

This invention also accommodates safe utilization of open (ductless) return air systems in such appliances. To accommodate usage of such ductless return systems, pressure sensing is provided between the indoor and outdoor wherein pressure differentials as little as 0.005 inches of water are sensed in the vicinity of the flue. In particular, the air pressure differential between the inside of the venting flue and the space in which the combustion appliances is operated is sensed and, if pressure differential turns negative (due to the operation of appliance power fans in the operating space or the like), alarms/communications are implemented and/or the closed combustion system power fans and/or the combustion appliance itself is shut down or otherwise controlled.

The airflow direction sensor apparatus of this invention includes an airflow passage, for example a tube, conducting air between different volumes. A first temperature sensitive sensor device, for example a thermistor, is positioned adjacent to one end of the passage. A second temperature sensitive sensor device (e.g., a second thermistor having an electrical resistance temperature curve closely matched to the first device) is located at an intermediate position in the passage. A heat source (for example, a thermostatically regulated heater) is located at an opposite end of the passage. Means associated with the first and second temperature sensitive devices compares the temperatures sensed by each of the devices and provides an output indicative of the comparison.

The sensor apparatus is highly sensitive to airflow direction changes and is well adapted for indicating positive and negative pressure differentials between the volumes. In particular, the apparatus is well adapted for use at a flue ported outside a facility and associated with a combustion appliance located in the facility. The tube conducts an airflow stream between first and second open ends, the first open end in communication with ambient temperature air from the facility and the second open end in communication with the flue. The first and second temperature sensors each provide an output signal, with the first sensor located adjacent to the first open end of the tube substantially out of contact with the airflow stream conducted by the tube. In this fashion, the first temperature sensor device is exposed to the ambient temperature in the facility. The heat source is located in the tube adjacent to the second open end.

In a preferred embodiment, the comparing means utilizes a comparator circuit for receiving the output signals from the temperature sensors, and other means are provided responsive to the output from the comparator circuit for advancing appropriate response to output indicative of irregular pressure differential at the flue (e.g., alarms, communications, system adjustment or shut-off).

The methods of this invention provide steps for highly sensitive airflow direction sensing of a conducted airflow in a passage between first and second volumes. The ambient temperature in the first volume is sensed and air at the passage adjacent to the second volume is heated. The temperature of the airflow being conducted in the passage is also sensed and the sensed ambient temperature and sensed conducted airflow temperature are compared on an on-going basis, an output indicative of compared ambient and conducted airflow temperatures being provided. Under normal circumstances, the airflow in the passage proceeds from the first volume to the second volume and the comparison remains constant. Under anomalous conditions, the airflow may reverse and the sensed temperature in the passage increases relative to the ambient sensed temperature due to the heating of air at the passage adjacent to the second volume.

It is therefore an object of this invention to provide an improved airflow direction sensor.

It is still another object of this invention to provide a highly sensitive airflow sensing apparatus for indicating positive and negative pressure differentials at a flue associated with a combustion appliance located in a facility.

It is yet another object of this invention to provide methods for highly sensitive airflow direction sensing.

It is another object of this invention to provide combustion appliance sensors/apparatus that are responsive to dangerous conditions prior to their threat to occupants of a facility and that are remediative.

It is still another object of this invention to provide sensors/apparatus and methods that are adaptable to provide response to low combustion appliance flue/chimney draft pressure differentials and that are capable of differentiating flue draft airflow direction.

It is yet another object of this invention to provide sensors/apparatus for application in facilities/homes using combustion appliances to enhance occupant safety by reliably indicating and responding to negative indoor pressure with respect to the outdoors.

It is still another object of this invention to provide sensors/apparatus that are adaptable so that a single sensor may be utilized system wide in a combustion appliance assemblage, that are simple to implement, install and/or adapt in various applications, and that are inexpensive.

It is still another object of this invention to provide sensors/apparatus adapted to allow safe utilization of completely open (ductless) return air systems.

It is another object of this invention to provide an airflow direction sensor that includes an airflow passage for conducting air between different volumes, a first temperature sensitive device adjacent to one end of the passage, a second temperature sensitive device at an intermediate location in the passage, a heat source at an opposite end of the passage, and means associated with the first and second temperature sensitive devices for comparing temperature sensed by each of the devices and providing an output indicative thereof.

It is still another object of this invention to provide a highly sensitive airflow sensing apparatus for indicating positive and negative pressure differentials at a flue associated with a combustion appliance located in a facility, the apparatus including a tube for conducting an airflow stream, the tube having first and second open ends, the first open end in communication with ambient temperature air from the facility and the second open end in communication with the flue, a first temperature sensor providing an output signal and located adjacent to the first open end of the tube substantially out of contact with the airflow stream conducted by the tube, whereby the first temperature sensor is exposed to the ambient temperature in the facility, a second temperature sensor at an intermediate location in the tube and providing an output signal, a heat source in the tube adjacent to the second open end, a comparator receiving the output signals from the first and second temperature sensors, comparing the signals and providing an output indicative of the comparison, and means responsive to the output from the comparator for advancing appropriate response to output indicative of irregular pressure differential at the flue.

It is yet another object of this invention to provide a highly sensitive airflow direction sensing method that includes the steps of conducting airflow in a passage between first and second volumes, sensing ambient temperature in the first volume, heating air at the passage adjacent the second volume, sensing temperature of the airflow being conducted in the passage, comparing sensed ambient temperature and sensed conducted airflow temperature, and providing an output indicative of compared ambient and conducted airflow temperatures.

With these and other objects in view, which will become apparent to one skilled in the art as the description proceeds, this invention resides in the novel construction, combination, and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

A preferred embodiment of this invention is illustrated in the FIGURES, which is illustrated and discussed for utilization in conjunction with a facility combustion appliance flue. Other applications of the sensor/apparatus and methods of this invention could be conceived as will be apparent from the description. As this description proceeds, the term "airflow" is utilized but should be understood to mean not only the flow of air, but the flow of any gaseous substances between two volumes (this definition is also applicable to the claims).

Figure 1:
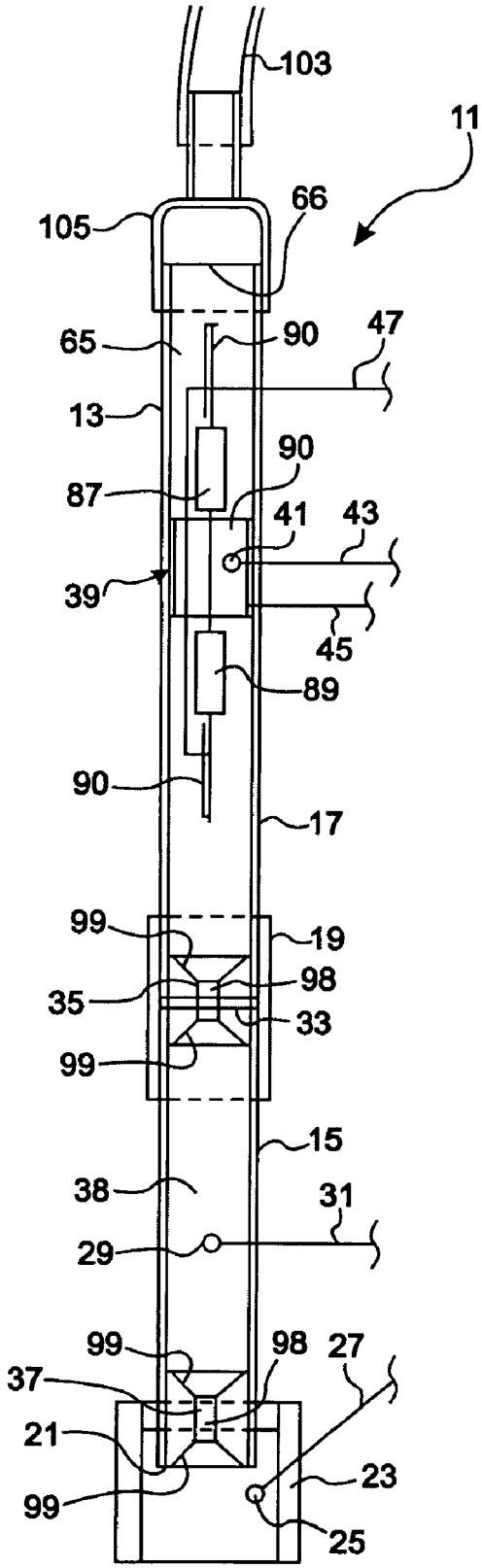
FIG. 1 illustrates a sensing unit of the flow direction sensor of this invention.
Figure 2:
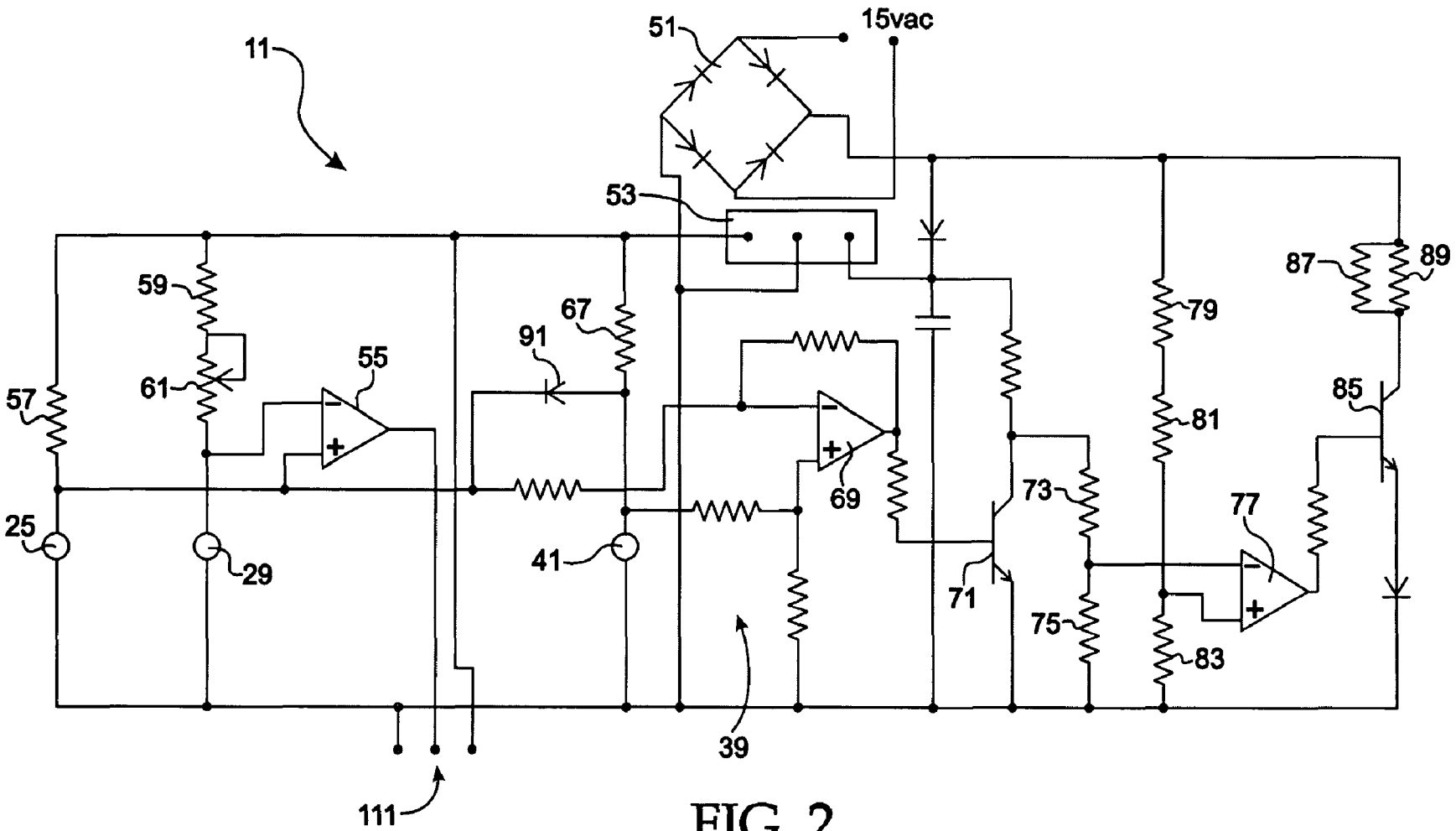
FIG. 2 is a circuit diagram illustrating integration of sensing unit components to provide useful output.

Turning now to the drawings, sensing apparatus 11 (also referred to herein as "sensor 11") is illustrated in FIGS. 1 and 2. Short tube 13 provides an airflow passage therethrough for conducting air or other gases between two volumes. Tube 13 in the illustrated application is adapted and oriented to conduct a stream of air or other gases between a flue and the ambient environment in which a combustion appliance is located. Tube 13 is preferably defined by two tube sections 15 and 17 secured together by a coupler 19. At open end 21 of tube section 15 of tube 13 (at the bottom of the tube when installed) a protective shield (or hood) 23 is received. The shield/hood provides a physically protected installation area characterized by a zone of still air therein, but is open at a selected aspect (the bottom of the hood for example) to ambient air conditions in the area of sensor installation in the facility where the combustion appliance is located.

Small temperature sensitive device 25 (preferably a negative temperature coefficient thermistor temperature sensor) is located adjacent to open end 21 of tube 13 within the protected area of shield 23 but at a position therein outside the field of influence of the in or out airflow stream conducted through tube 13. Device 25 registers facility installation room ambient temperature, providing an output signal indicative thereof via electrical leads 27. Positioned at an intermediate location in tube 13, in tube section 15, is another temperature sensitive device 29 (preferably again a negative temperature coefficient thermistor having closely matched response characteristics to device 25). Device 29 registers the tube conducted airflow temperature, providing an output signal indicative thereof via electrical leads 31.

Thermistor device 29 is isolated by flow regulators 35 and 37 at tube section 15 opposite end 33 (in the middle of tube 13) and at tube open end 21, respectively. Regulators 35 and 37 effectively eliminate circulating or turbulent flow inside tube compartment 38 from either end. Tube section 17 (the upper tube section in this installation) has thermostatically regulated heat source 39 established therein, the temperature of which is controlled by thermistor device 41 and related circuitry connected via leads 43 to be approximately 36° F. above that of the ambient temperature as registered by device 25. Heat source 39 is powered through supply leads 45 and 47 which are of small diameter (for example, 32 gauge to minimize heat conduction outside of tube 13).

Circuit board 49 (see FIG. 4) mounts circuitry for operation and integration of sensor components. All electrical leads from the tube are terminated on this board as may be appreciated from FIG. 2. Power is supplied to all devices from a 15 volt wall transformer (not shown). Full wave rectifier 51 and a 12 volt regulator unit 53 (for example, an LM 7812 12 v regulator) provide 12 volts to devices 25 29 and 41 and operational amplifier/voltage comparator 55. Thermistor devices 25 and 29, nominally 10K ohms each with a resistance tolerance of no better than +/−10%, are each voltage biased through electrical resistors 57, 59, and 61 to a well regulated 12 volts. The electrical resistance of the resistors is chosen so that the voltage at normal room temperature is approximately equally split between resistors 57 and 59 plus 61 and the respective thermistor device 25/29. Thermistors 25 and 29 are chosen to have closely matched electrical resistance temperature curves over the expected possible room ambient temperature variations. Expected curve matching in the temperature range of 32° F. to 150° F. is as good as 0.2 percent or better using 10K3A1B thermistors from BETATHERM.

Resistor 61 in series with thermistor device 29 is manually adjustable (for example, a 2.5 k 20 turn pot). With no airflow through tube 13, this resistor is adjusted so that the voltage on the minus input to comparator 55 is higher than the positive input by the voltage equivalent of 1.8 F temperature. This arbitrary ΔT differential is based on the available curve matching thermistors used as well as other influences such as the heater temperature (described below), insulation of heater compartment 65 and the degree to which prevention of random circulation of heated air from compartment 65 is achieved. The electrical resistance of the thermistors used in the disclosed application changes by approximately −2.4 percent per 1.0 F temperature rise. Thus, the resulting voltage difference on the two thermistors with equivalent temperatures is approximately 300 mv. In other words, for the disclosed application utilizing the BETATHERM thermistors the voltage on device 29 is approximately 300 mv higher than the voltage on device 25. Because of the close curve matching of the two thermistors, the 300 mv voltage difference will be substantially maintained over expected room temperature variation.

With ambient air flowing into open end 21 at the bottom of tube 13, comparator 55 output will be low indicative of a safe operating environment. The electronic low can be used to drive indicators that room pressures are satisfactory for normal operations (as described hereinafter). If the flow through the tube is reversed, air will enter open end 66 of tube 13 (at the top of tube 13) and be conducted over heat source 39 and then across thermistor device 29 to heat it above thermistor device 25. This will drive the negative input to comparator 55 lower and consequently the output of comparator 55 goes high. This electronic high can be used to drive audible and visible signals of occurring problems, as well as operating (to mitigate) or disabling appliance equipment causing the problem.

Electric heat source 39 is controlled by thermistor device 41 (again preferable a 10K3A1B thermistor from BETATHERM) in series with smaller resistor 67 (for example, a 5.6 k resistor). This arrangement requires thermistor device 41 to control heat rise to approximately 36° F. in order to bring the overall voltage equal to that on thermistor device 25. The difference voltage on device 41 as compared to the voltage on device 25 is amplified (four times in this configuration) by operational amplifier 69, the output of amplifier 69 being inverted by transistor amplifier 71. This inverted voltage is halved by resistors 73 and 75 in order to keep the minus input voltage on operational amplifier 77 (the "clipping level") within its input voltage range. The positive input on this same amplifier is the rectified power voltage (15 v) from full wave rectifier 51 (again divided by a factor of 2 by resistors 79, 81, and 83). Amplifier 77 drives power transistor 85 fully on or fully off around the clipping level.

Figure 3:
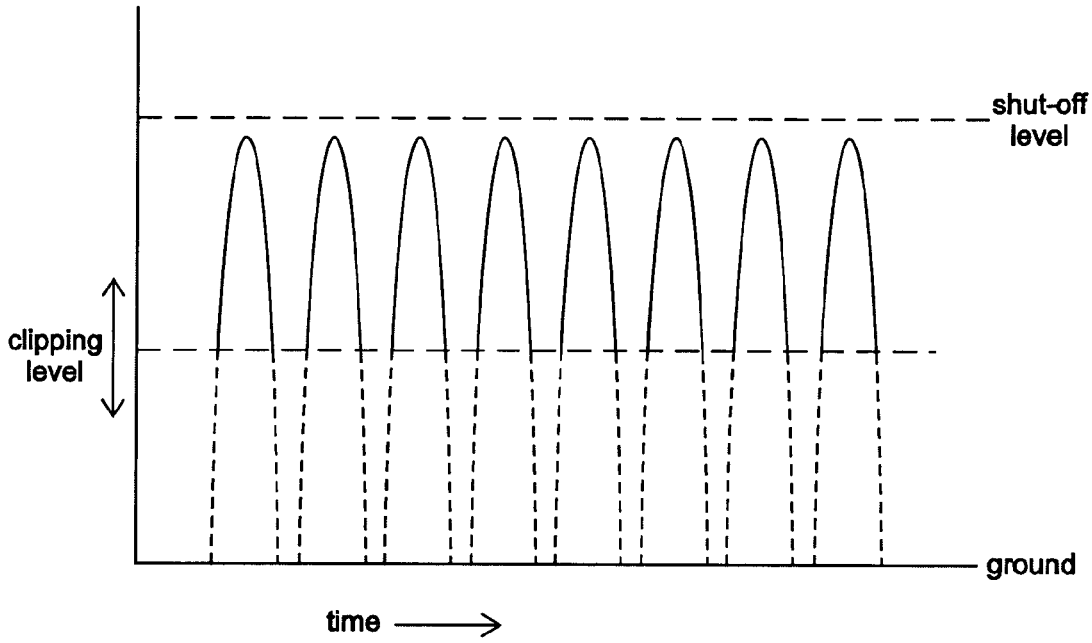
FIG. 3 is a graphical illustration describing power supply to the sensing unit heater.

An illustrative diagram of the input voltages on amplifier 77 is provided in FIG. 3. As noted, the minus input is the clipping level (the amplified voltage due to temperature variations around the 36° F. temperature rise between turn-on and shut-off levels) and the plus input is the rectified AC voltage. As heater resistors 87 and 89 start heating (heating air/gas in compartment 65 in conjunction with brass or other material heat sinks 90), the clipping level is near ground and full power is being applied to the heat source 39. As thermistor device 41 heats up and its voltage drops, eventually to a point indicative of the desired 36° F. rise in temperature being met (the shut-off level). The clipping level moves up, eventually shutting off the power to heat source 39 when the desired temperature rise is met. The rectified 60 cycle power controlling transistor 85 is always either turned fully on (above the clipping level) or completely off (below the clipping level). If the heater should malfunction and provide no heat above the ambient temperature, feedback through diode 91 from the voltage on device 41 drives comparator 55 to high output (providing a failsafe alarm status).

Since the satisfactory functioning of sensor/apparatus 11 depends on its reliability and sensitivity to reversals of small pressures differentials, and since nuisance tripping or the lack of appropriate tripping when there has been a small reversal of pressures would be unacceptable, various design implementations to enhance operations while alleviating such problems are preferred. Use of a plastic pipe, the walls of which are not a good conductor of heat, is preferably utilized for tube sections 15 and 17. So that heat source 39 substantially only heats the upper section 17 of tube 13, coupler 19 and flow regulator 35 should be of material selected to assist thermal isolation of tube sections 15 and 17. Tube 13 should be substantially linear thus minimizing non-linear or turbulent air circulation between different compartments of the tube. Streamlining flow regulators 35 and 37 are provided with small central flow-through passages 98 to thereby inhibit turbulent circulation of heated air and regulate air flow to provide a more directional flow. The cone shaped entrances/exits 99 of regulators 35 and 37 (an approximately 100° cone wall angle being preferred) to central passages 98 further facilitate streamlined flow.

In the particular application illustrated herein, tube 13 is mounted vertically with the heat source end toward the top so that the lighter warmed air remains at top compartment 65 in the absence of reverse flow conditions. Smaller diameter conduit 103 (preferably a plastic material tube) is secured at one end on adapter 105 mounted over open end 66 of tube section 17 of tube 13, the opposite end of tube 103 being positioned in communication with the second volume of air or other gas (the interior of the combustion appliance flue, for example). Tube 103 should be as short as possible with smooth, large radius curves and no kinks to provide a very low resistance to free airflow from the other air volume to tube 13. A tube 103 diameter of ⅜ inch or larger is preferable for the application illustrated herein.

Figure 4:
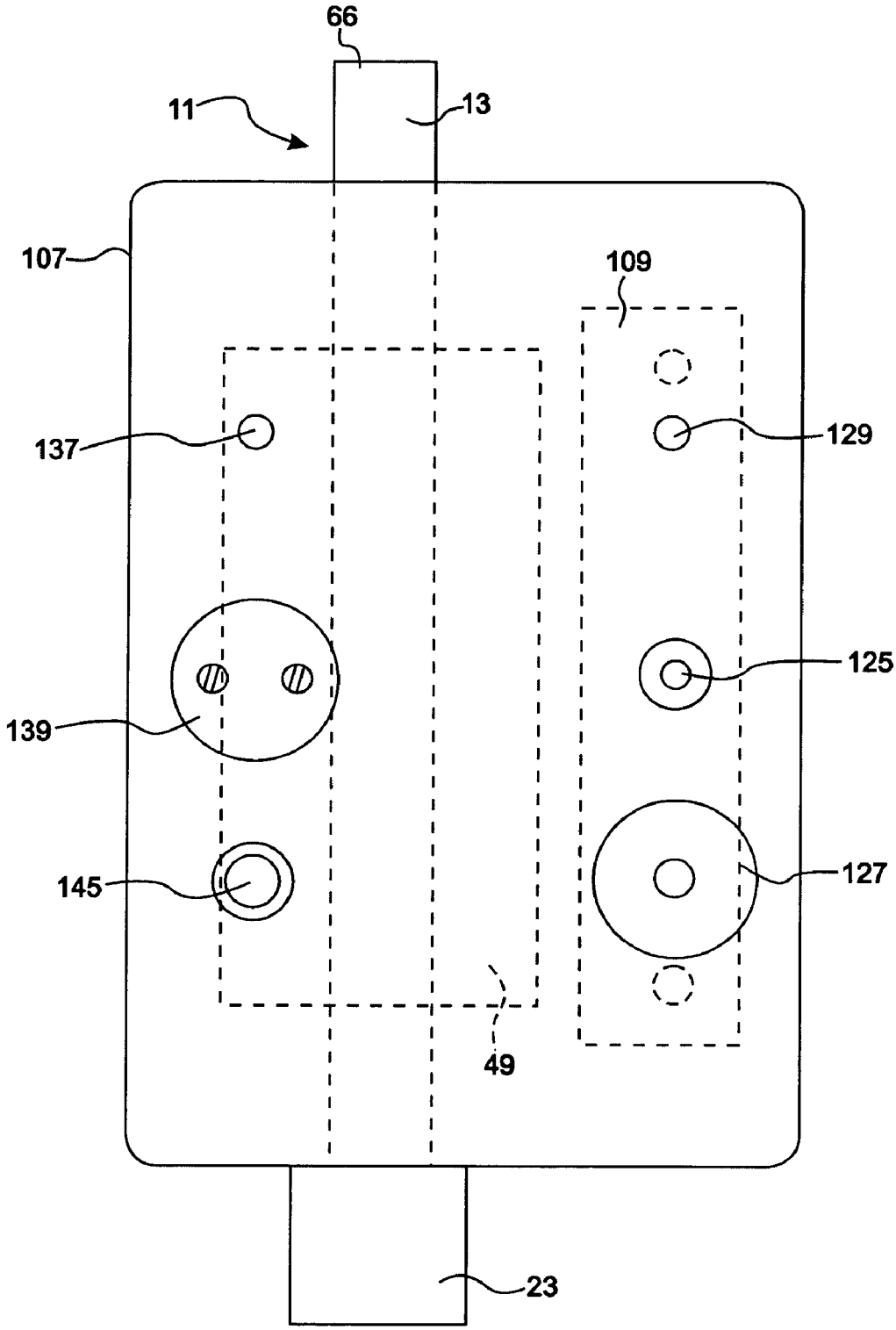
FIG. 4 is a diagrammatic illustration of a housing which may be utilized to mount the sensing unit and circuitry of FIGS. 1 and 2, and to provide operational controls and output indicators thereat.
Figure 5:
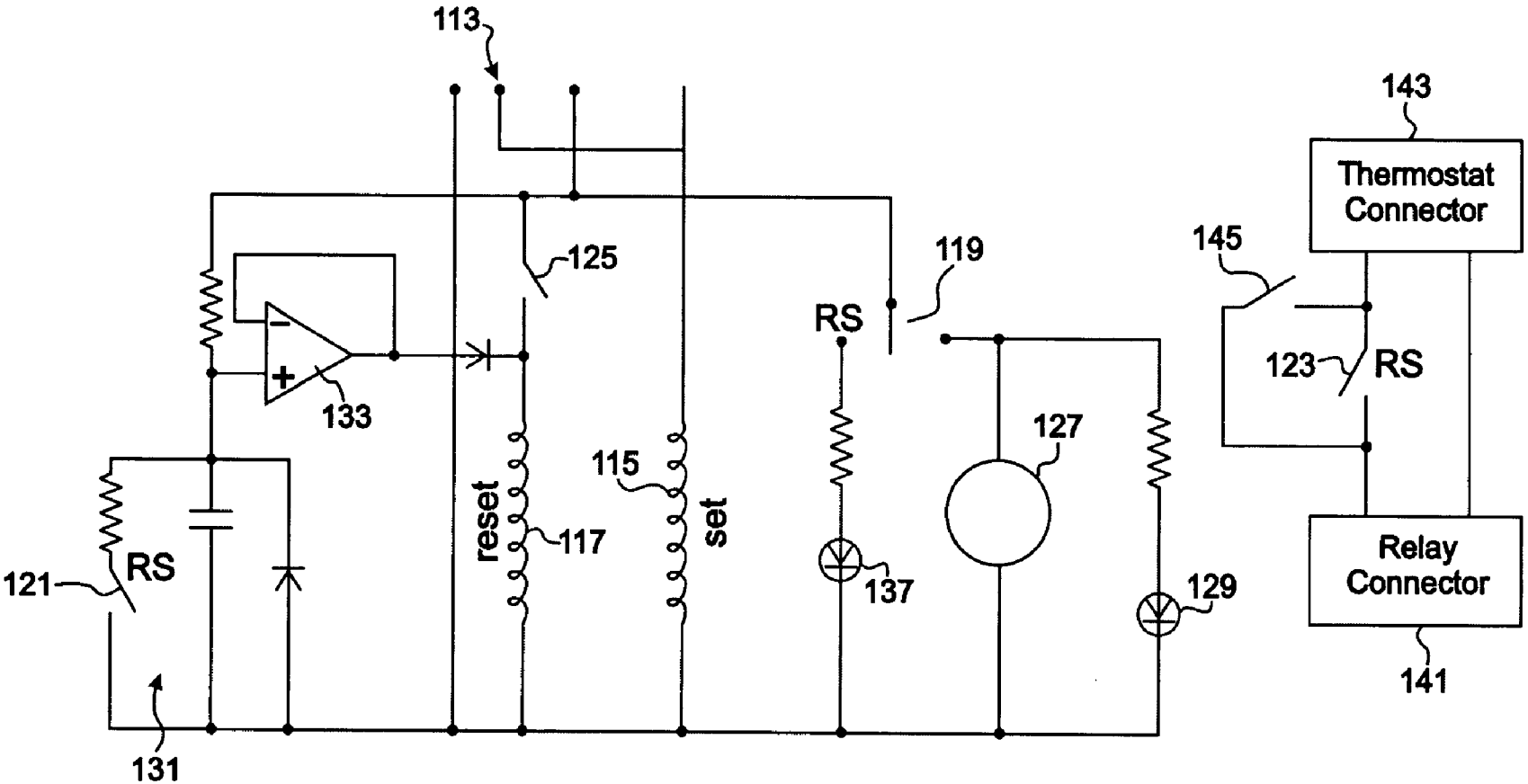
FIG. 5 is a circuit diagram showing integration of the sensing unit, circuitry, output indicators and operational controls at the housing of FIG. 4.

To implement sensor/apparatus 11 with an HVAC installation, housing 107 is utilized as shown in FIG. 4. Tube 13 and circuit board 49 are mounted therein, and a second circuit board 109 is provided therein, preferably attached to a removable lid of the housing. Circuitry and components as illustrated in FIG. 5 are maintained at board 109 to support the visible and audible signals, manual reset capabilities and switch terminals interrupting the connections between the thermostat and the combustion appliance (furnace/AC relay). A three wire cable extends between connector 111 at circuit board 49 (see FIG. 2) and connector 113 on board 109 (see FIG. 5). A bi-stable mechanical relay circuit includes set and reset coils 115 and 117, respectively. Three pole switch 119 and two pole switches 121 and 123 (the furnace/AC relay) are labeled S (set) and RS (reset) to designate which switches are closed when the set or reset coil is energized.

With operator intervention, sensor/apparatus 11 is operational after the manual reset button switch 125 has been pushed. Whenever voltage comparator 55 on board 49 goes high, set coil 115 is activated, switch 119 is closed to the set side and switches 121 and 123 are opened. This activates buzzer 127 and LED 129 providing audible and visible signals of system problems, and initiates combustion appliance (furnace/AC) shut-off. After operator intervention to remedy the problem, manual reset is initiated by pushing button 125 thereby actuating reset coil 117.

If an operator is unavailable to respond, circuit components 131 at operational amplifier 133 will cause repeated periodic reset attempts (for example, at 30 minute intervals), and reset the system if voltage comparator 55 output is again low. Additional circuit components could be provided to limit the number of reset attempts to a selected number of attempts, thereafter remaining in the set mode if reset is unsuccessful (i.e., comparator 55 has not returned to low output). After reset at switch 125 or by circuit 131, and so long as comparator 55 remains low, reset coil 117 is activated and switch 119 is closed to the reset side and switch 123 closed (as is switch 121) allowing normal system operations as indicated by LED 137.

Housing 107 is preferably a rectangular plastic box having a removable lid on the front with tube 13 passing through openings in the top and bottom of the box. Terminal block 139 for system connections to connectors 141 and 143 is provided at housing 107, as is manual shorting switch 145 (between thermostat and furnace/AC relay). A power cord (not shown) extends from housing 107 to the wall transformer providing 15 volt AC input power.

Indicative of operation in conditions wherein a positive indoor pressure is present (as is desirable), air flows into the bottom of the tube 13 and temperature sensitive device 25 registers a temperature equivalent to the ambient indoor temperature in an area of still air just outside of the tube bottom (i.e., at the first volume). Inputs to voltage comparator 55 are the voltages on the two sensing devices 25 and 29, biasing on the devices being such that for equal temperatures at each the comparator output is low. If the outdoor pressure (i.e., pressure at the second volume) were greater than the indoor pressure (as is undesirable), air would flow into the top of tube 13 from the flue and over heat source 39, the warmed air then reaching temperature sensitive device 29 significantly raising its temperature. The increased temperature sends comparator 55 output high indicative of an undesired reverse flow, and audible and visible signals of problems and/or automatic shutdown or remediation of the combustion appliance systems are initiated.

Voltage biasing of sensor thermistor device 29 input to comparator 55 requires a tradeoff between reliability and sensitivity when selecting the size of $\Delta T$. Choosing a small $\Delta T$ means higher sensitivity to airflow reversal but perhaps less reliability (more false switching). By reducing sensitivity (increasing $\Delta T$), reliability will be improved. To offset this tradeoff when using thermistors, higher precision curve matching should be utilized. With the implementation as described herein, pressure reversal of as little as 0.001 inch water column can be sensed while preserving sensor/apparatus reliability.

The airflow direction sensor/apparatus of this invention can also be adapted for use to sense the size of the airflow or a value proportional to the sensed pressure differentials. The thermistors taught herein are self heated by voltage biasing. The self heating effect is greatest in a still air environment and the effect decreases as the air movement past the thermistor increases. As airflow into the bottom of tube 13 increases, thermistor device 29 is subjected to more air movement than thermistor device 25 which remains in a still air environment. This cools device 29 more than device 25 and $\Delta T$ increases ($\Delta T$ as discussed hereinabove always referred to the situation with no air movement). Measurement of the voltage difference between outputs from devices 25 and 29 would be indicative of airflow volume through tube 13 (and by computation, the size of the pressure differential between the two air bodies).

The ease of implementation and reliability of sensor/apparatus 11 is due to the availability of precision, stable negative temperature coefficient thermistors or alternative temperature sensitive devices (such as LM135/LM335 precision temperature sensors). The electrical resistance versus temperature of the thermistor-type sensors tracks a known curve to a high degree of accuracy. The LM135/LM335 sensors indicate temperature to an accuracy of better than 1.8° F. over a very wide range of temperatures. The stability of such sensors has been studied and confirmed over years of operation in different environments.

As may be appreciated from the foregoing, the airflow direction sensors/apparatus and methods of this invention provide output of the existence of small pressure differentials between two bodies of air and whether the differentials are positive or negative. The sensor/apparatus can be utilized wherever such output may be utilized, such as in clean rooms, industrial applications, and homes or other habitations and facilities using modern combustion appliances. In the latter case, the sensor is utilized to sense flue draft due to the chimney effect or lack thereof due to negative pressure indoors with respect to outdoors. The sensor/apparatus is highly accurate (to about +/−0.001 inches of water column), simple to install and use, stable over a wide range of ambient temperatures, reliable and inexpensive.

What is claimed is:

1. An airflow direction sensor comprising:

an airflow passage for conducting air between different volumes;

a first temperature sensitive device adjacent to one end of said passage;

a second temperature sensitive device at an intermediate location in said passage;

a heat source at an opposite end of said passage; and comparing means associated with said first and second temperature sensitive devices for comparing temperature sensed by each of said devices and providing an output indicative thereof.

2. The sensor of claim 1 wherein said airflow passage is defined by a substantially linear tube compartmentalized with said second temperature sensitive device in a first compartment thereof and said heat source in a second compartment thereof.

3. The sensor of claim 2 wherein said first compartment of said tube is established by first and second flow regulators in said tube at each side of said second temperature sensitive device.

4. The sensor of claim 1 further comprising means at said one end of said passage establishing an area of still air and having said first temperature sensitive device maintained therein.

5. The sensor of claim 1 wherein said comparing means provides an output indicative of a safe environment when temperature sensed at said first temperature sensitive device is equal to or higher than temperature sensed at said second temperature sensitive device, and wherein said comparing means provides an output indicative of an unsafe environment when temperature sensed at said first temperature sensitive device is lower than temperature sensed at said second temperature sensitive device.

6. The sensor of claim 1 wherein said heat source includes means for thermostatic regulation thereof to maintain a significant temperature rise thereat above ambient temperature as indicated by said first temperature sensitive device.

7. A highly sensitive airflow sensing apparatus for indicating positive and negative pressure differentials at a flue associated with a combustion appliance located in a facility, said apparatus comprising:

a tube for conducting an airflow stream, said tube having first and second open ends, said first open end in communication with ambient temperature air from the facility and said second open end in communication with the flue;

a first temperature sensor providing an output signal and located adjacent to said first open end of said tube substantially out of contact with the airflow stream conducted by said tube, whereby said first temperature sensor is exposed to the ambient temperature in the facility;

a second temperature sensor at an intermediate location in said tube and providing an output signal;

a heat source in said tube adjacent to said second open end;

a comparator receiving said output signals from said first and second temperature sensors, comparing said signals and providing an output indicative of comparison; and means responsive to said output from said comparator for advancing appropriate response to said output when indicative of irregular pressure differential at the flue.

8. The apparatus of claim 7 further comprising feedback means associated with said heat source and said comparator to initiate one of alarm or remediation at said means responsive to said output in case of heat source malfunction.

9. The apparatus of claim 7 wherein said temperature sensors include thermistors having closely matched electrical resistance temperature curves, said apparatus further comprising means for establishing an offset voltage providing, at equivalent temperatures, a selectable higher voltage at said second temperature sensor.

10. The apparatus of claim 9 wherein said heat source includes a heater thermostatically controlled by a thermistor circuit maintaining a selected heat rise relative to ambient temperature output at said first sensor.

11. The apparatus of claim 7 wherein said tube is substantially linear and includes two tube sections defining separate tube compartments each having different ones of said second temperature sensor and said heat source maintained therein.

12. The apparatus of claim 7 further comprising a smaller diameter conduit connected at said second open end of said tube and extending into the flue.

13. The apparatus of claim 7 further comprising a housing for maintaining and mounting said apparatus in the vicinity of the combustion appliance.

14. A highly sensitive airflow direction sensing method comprising the steps of:

conducting airflow in a passage between first and second volumes;

sensing ambient temperature in said first volume;

heating air at said passage adjacent said second volume;

sensing temperature of said airflow being conducted in said passage;

comparing sensed ambient temperature and sensed conducted airflow temperature; and providing an output indicative of compared ambient and conducted airflow temperatures.

15. The method of claim 14 wherein, with airflow from said first volume to said second volume, said output indicative of compared temperatures provides a non-alarm status indication and, with airflow from said second volume to said first volume, said output indicative of compared temperatures provides an alarm status indication.

16. The method of claim 14 wherein the step sensing ambient temperature in said first volume includes sensing adjacent to said passage but outside any airflow stream conducted through said passage.

17. The method of claim 14 further comprising the step of establishing a selected constant temperature offset in advance of sensing temperature of said airflow being conducted in said passage.

18. The method of claim 14 wherein the step of heating air includes regulating temperature rise to a selected constant rise above sensed ambient temperature.

19. The method of claim 14 wherein the step of conducting airflow includes said first volume being ambient environment in a facility having a combustion appliance and said second volume being exterior of said facility and communicated through a flue associated with the combustion appliance.

20. The method of claim 19 further comprising the steps of providing feedback indicative of cessation of air heating at said passage adjacent to said second air volume and initiating appropriate response thereto.

* * * * *